US011730224B2

(12) United States Patent
Rietdyk

(10) Patent No.: US 11,730,224 B2
(45) Date of Patent: Aug. 22, 2023

(54) LATTICED COMFORT LINER

(71) Applicant: LIFT Airborne Technologies LLC, Rancho Dominguez, CA (US)

(72) Inventor: Guido Rietdyk, Rolling Hills, CA (US)

(73) Assignee: LIFT Airborne Technologies LLC, Rancho Dominguez, CA (US)

( * ) Notice: Subject to any disclaimer, the term of this patent is extended or adjusted under 35 U.S.C. 154(b) by 302 days.

(21) Appl. No.: 17/100,743

(22) Filed: Nov. 20, 2020

(65) Prior Publication Data

US 2022/0160068 A1 May 26, 2022

(51) Int. Cl.
*A42B 3/12* (2006.01)

(52) U.S. Cl.
CPC ..... *A42B 3/12* (2013.01)

(58) Field of Classification Search
CPC ..... A42B 3/12; A42B 3/124; A42B 3/10
See application file for complete search history.

(56) References Cited

U.S. PATENT DOCUMENTS

| | | | | |
|---|---|---|---|---|
| 9,314,060 | B2 | 4/2016 | Giles | |
| 9,320,311 | B2 | 4/2016 | Szalkowski et al. | |
| 9,924,756 | B2 | 3/2018 | Hyman | |
| 2013/0273273 | A1 | 10/2013 | Greenhill et al. | |
| 2016/0159033 | A1 | 6/2016 | Greenhill et al. | |
| 2018/0140037 | A1 | 5/2018 | Frieder, Jr. et al. | |
| 2019/0045870 | A1 * | 2/2019 | Safar | B32B 3/08 |
| 2019/0133235 | A1 | 5/2019 | Domanskis et al. | |
| 2020/0190357 | A1 | 6/2020 | Rolland et al. | |
| 2021/0187897 | A1 * | 6/2021 | Reinhall | B32B 27/08 |
| 2022/0192307 | A1 * | 6/2022 | Light | A42B 3/06 |
| 2022/0322780 | A1 * | 10/2022 | Weber | A42B 3/063 |
| 2022/0386733 | A1 * | 12/2022 | Merlo | A41D 13/0156 |
| 2023/0061962 | A1 * | 3/2023 | Dumph | A42B 3/064 |

FOREIGN PATENT DOCUMENTS

| | | | | |
|---|---|---|---|---|
| EP | 3130243 | A1 | 2/2017 | |
| WO | 2016030547 | A1 | 3/2016 | |
| WO | 2020107003 | A1 | 5/2020 | |
| WO | WO-2020102335 | A1 * | 5/2020 | A42B 3/125 |

OTHER PUBLICATIONS

Carbon Inc.; Riddell® Speedflex Diamond Helmet; https://carbon3d.com/riddell/; Published 2019; accessed Sep. 3, 2020; 8 pages.

HEXR Products; A New Standard in Helmet Safety and Performance; https://hexr.com/app or https://hexr.com/; Published Apr. 2020; 7 pages.

* cited by examiner

*Primary Examiner* — Tajash D Patel
(74) *Attorney, Agent, or Firm* — Lowe Graham Jones PLLC

(57) ABSTRACT

Embodiments are directed toward a comfort liner for a helmet. The comfort liner preferably includes a latticed structure configured to couple to the helmet. The latticed structure is preferably elastically compressible and configured to prevent rotation of the helmet relative to a wearer's head in at least one dimension.

25 Claims, 19 Drawing Sheets

LATTICED COMFORT LINER

FIELD OF THE INVENTION

The invention relates generally to helmets and, more particularly, to comfort liners in helmets.

BACKGROUND OF THE INVENTION

Helmets often include an outer shell, an impact liner (for example, expanded polystyrene (EPS) or expanded polypropylene (EPP) foam), and a comfort liner (sometimes called a sizing liner) disposed opposite the impact liner from the shell. The impact liner between the shell and the comfort liner absorbs energy from impacts to the shell to reduce the energy that is transferred to the wearer's head. The comfort liner between the shell and the wearer's head makes the helmet more comfortable to wear against the head and is typically made of foam. However, the liner also allows some rotation of the shell of the helmet relative to the head of the user. Some helmets include a RIPS (rotational impact performance system), which typically features an impact liner or a low-friction slip-plane liner that gives way to shear forces to allow the helmet to rotate in all dimensions relative to the wearer's head. The inventor of the present invention discovered that helmets with typical RIPS may work well for light-weight helmets such as bicycle helmets, equestrian helmets, construction helmets, ski helmets, or even motorcycle helmets but that, for helmets having equipment designed to align with the wearer's eyes (for example, Joint Helmet Mounted Cueing System (JHMCS), heads-up-displays (HUDs), or night-vision goggles), the typical RIPS decreases usability of the helmet.

SUMMARY OF THE INVENTION

It is therefore an object of the present invention to provide a helmet comfort liner that prevents rotation of a helmet relative to a wearer's head in at least one dimension.

It is also an object of the present invention to provide a helmet comfort liner that achieves the above object and that also allows rotation of the helmet relative to the wearer's head in at least one dimension.

It is another object of the present invention to provide a helmet comfort liner that achieves the above objects and that also is elastically compressible.

It is a further object of the present invention to provide a helmet comfort liner that achieves the above objects and that also vents heat away from the wearer's head.

It is yet another object of the present invention to provide a helmet comfort liner that achieves the above objects and that also facilitates coupling the comfort liner to an impact liner that includes tubular members having central axes that are substantially normal to the corresponding surface of the wearer's head, such as the impact liner available from KOROYD.

The invention achieves the above objects, as well as other objects and advantages that will become apparent from the description that follows, by providing a helmet comfort liner. The comfort liner preferably includes a latticed structure configured to the helmet. The latticed structure is preferably elastically compressible and configured to prevent rotation of the helmet relative to a wearer's head in at least one dimension.

In some versions, the comfort liner includes a coupler that is configured to couple the latticed structure to an impact liner that is disposed between the latticed structure and a shell of the helmet.

The latticed structure preferably has multiple layers of different lattice patterns. In some versions, the multiple layers include a layer that has a plurality of triangular structures arranged in an array of columns and rows. In some versions, every fifth triangular structure in one of the rows has a vertex that is radially aligned with a convergence point that is disposed in a different layer than the layer having the plurality of triangular structures.

The latticed structure is preferably configured to prevent rotation of the helmet relative to the wearer's head in a median dimension. In some versions, the latticed structure is configured to allow rotation of the helmet relative to the wearer's head in a frontal dimension.

The coupler preferably includes a receptacle configured to receive a pin that is configured to extend through the receptacle to an impact liner or a shell of the helmet. In some versions, the receptacle has an inner collar, an outer collar, and a plurality of columns that extend from the inner collar to the outer collar. In some versions, the columns are spaced apart from each other about a perimeter of the receptacle. In some versions, the columns are elastically collapsible. In some versions, the receptacle defines a radial axis. In some versions, the columns have a non-circular cross-section as measured in a dimension that is transverse to the radial axis.

The comfort liner preferably includes a side unit. In some versions, the latticed structure and the coupler define a top unit configured to be disposed radially outward from a top of the wearer's head. In other versions, the latticed structure and the coupler define a frontal unit configured to be disposed radially outward from the wearer's forehead. In some versions, the side unit includes another latticed structure and another coupler that is configured to couple the side unit to the helmet. In some versions, the other latticed structure of the side unit is elastically compressible and prevents rotation of the helmet relative to the wearer's head in one or more dimensions that includes a first dimension that is transverse to a second dimension included in the at least one dimension. In some versions, the latticed structure of the top unit and the latticed structure of the frontal unit prevent rotation of the helmet relative to the wearer's head the second dimension.

The comfort liner preferably includes a fabric cover that is configured to cover the latticed structure. In some versions, the cover has an inner side and an outer side. In some versions, the outer side of the cover defines an opening that is configured to align with the coupler to facilitate coupling the latticed structure to the helmet.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
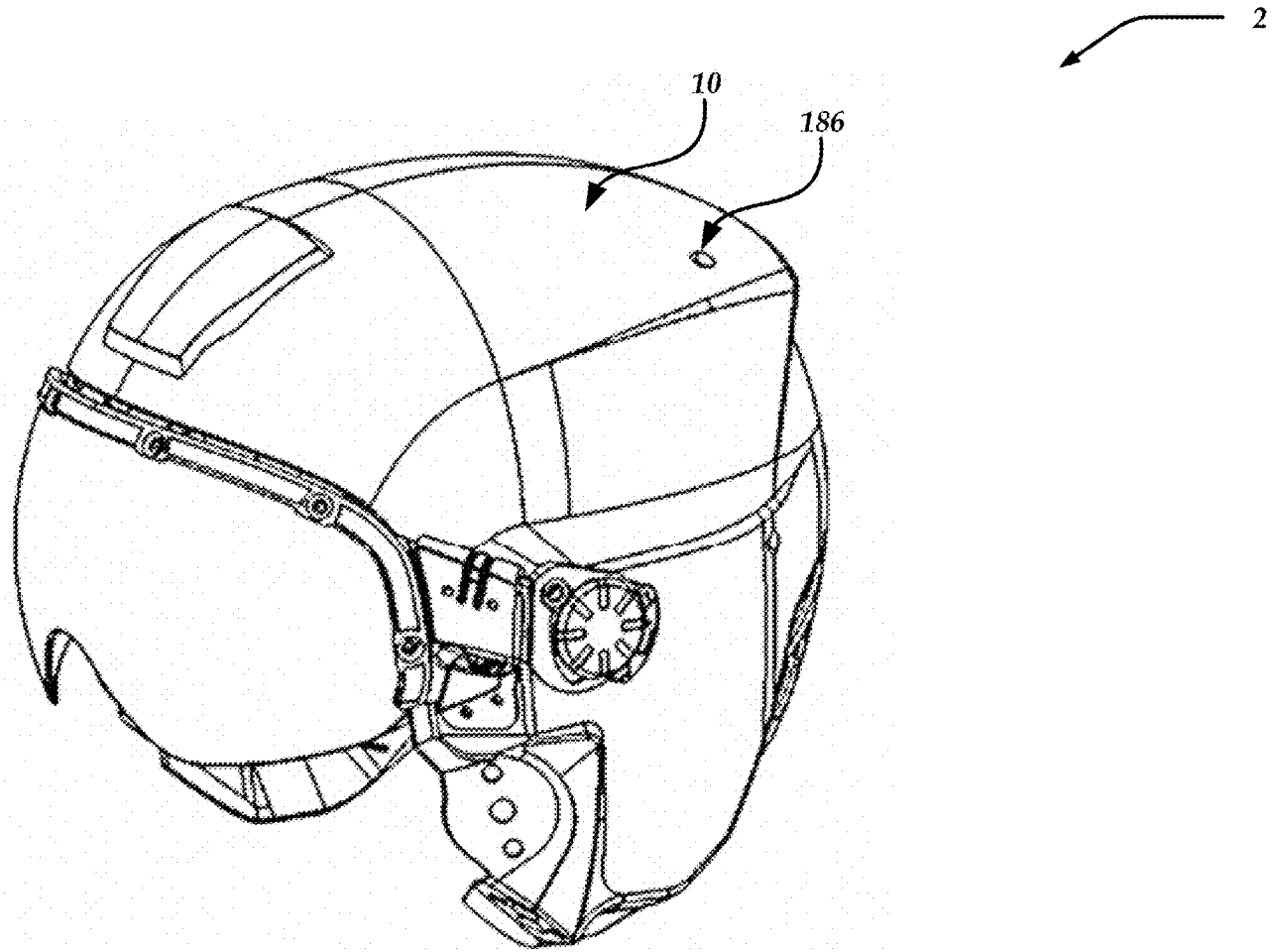
FIG. 1 is a front-left view of a preferred flight helmet.
Figure 2:
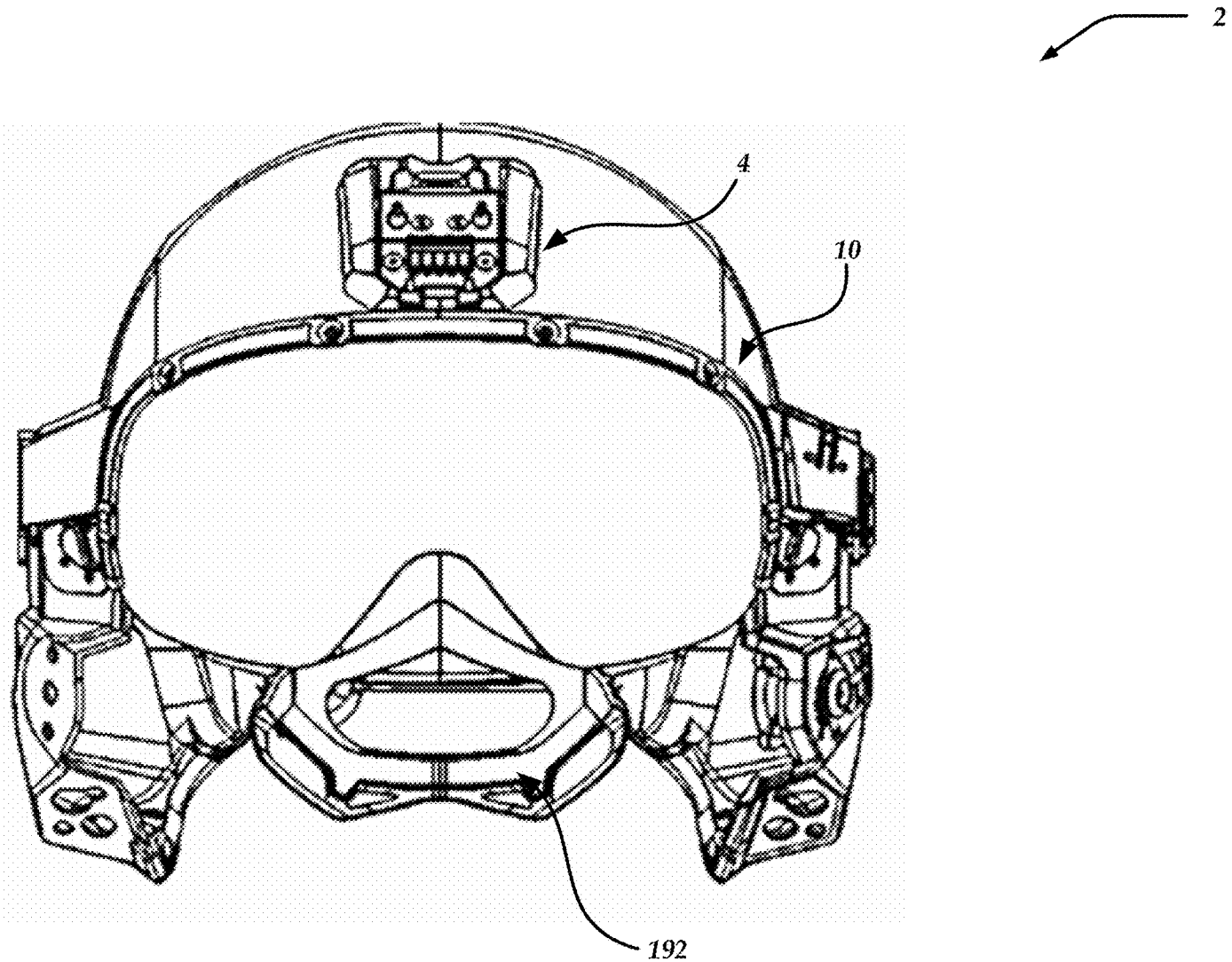
FIG. 2 is a front view of the helmet of FIG. 1.
Figure 3:
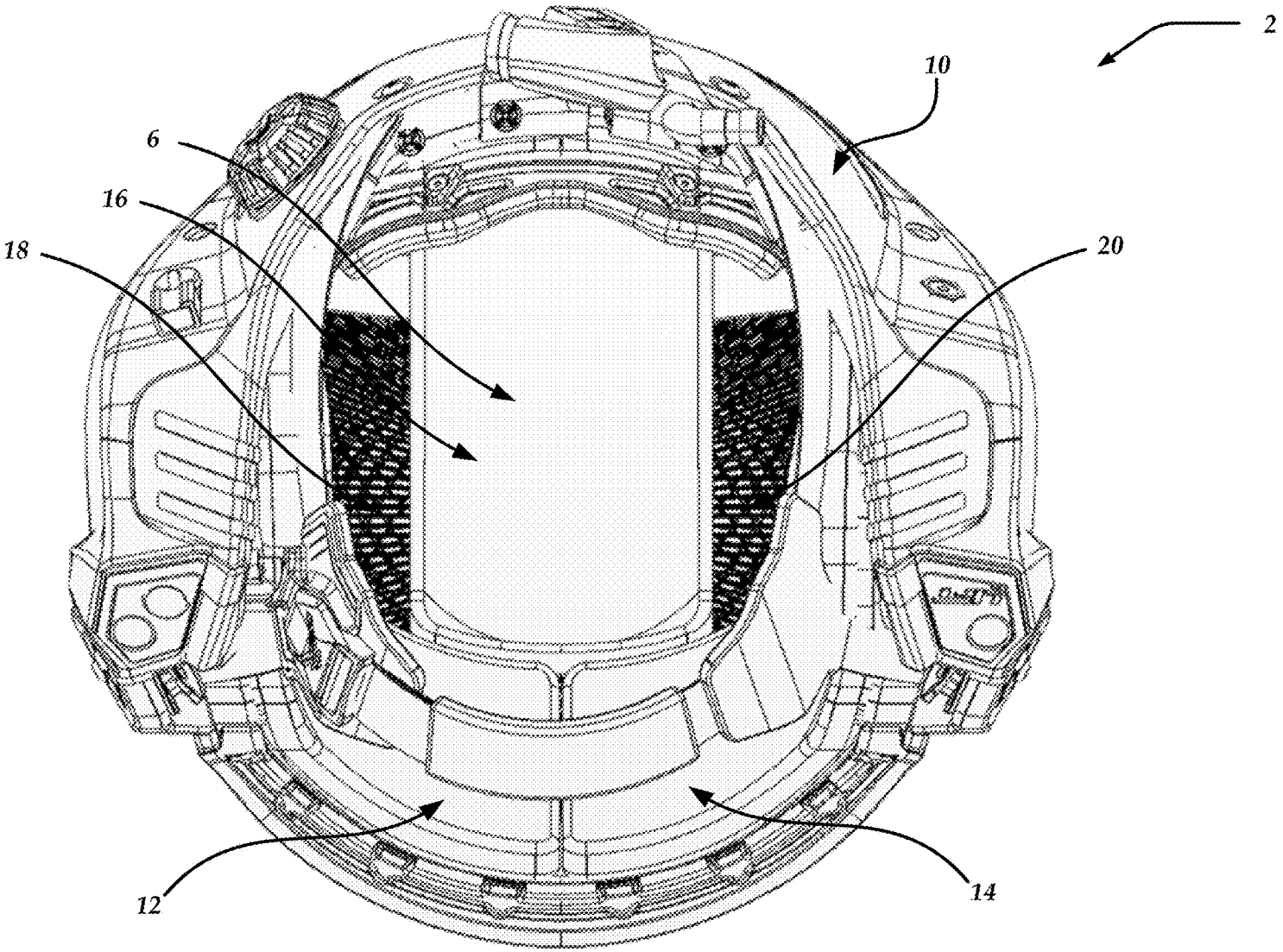
FIG. 3 is an underside view of the helmet of FIG. 1, showing a portion of a preferred comfort liner with the fabric liner removed.

A preferred flight helmet 2 in accordance with the principles of the invention is shown in FIG. 1. As shown in FIG. 2, the helmet 2 preferably has a structure 4 that facilitates mounting gear (not shown) to the helmet 2, such as Joint Helmet Mounted Cueing System (JHMCS), night-vision goggles, or heads-up-display (HUD) system. Such gear may weigh around 2.5 pounds and may place high stress on the wearer, especially when the wearer experiences high gravitational forces (for example, high gravitational forces during extreme flight maneuvers). As shown in FIG. 3, the helmet 2 has a preferred comfort liner (or sizing liner) 6 disposed opposite an impact liner 8 (see FIG. 17) from a shell 10. As shown in the inner-side plan view of FIG. 4, the comfort liner 6 preferably includes multiple units, such as a left frontal unit 12, a right frontal unit 14, a top unit 16, a left side unit 18, and a right side unit 20. As further discussed with respect to FIG. 18, the comfort liner 6 preferably has a fabric cover for each of the units 12-20 (see units 12-16 in FIG. 3), and such covers are removed in FIGS. 4-15 and 17 to show the structures of the units 12-20.

Figure 4:
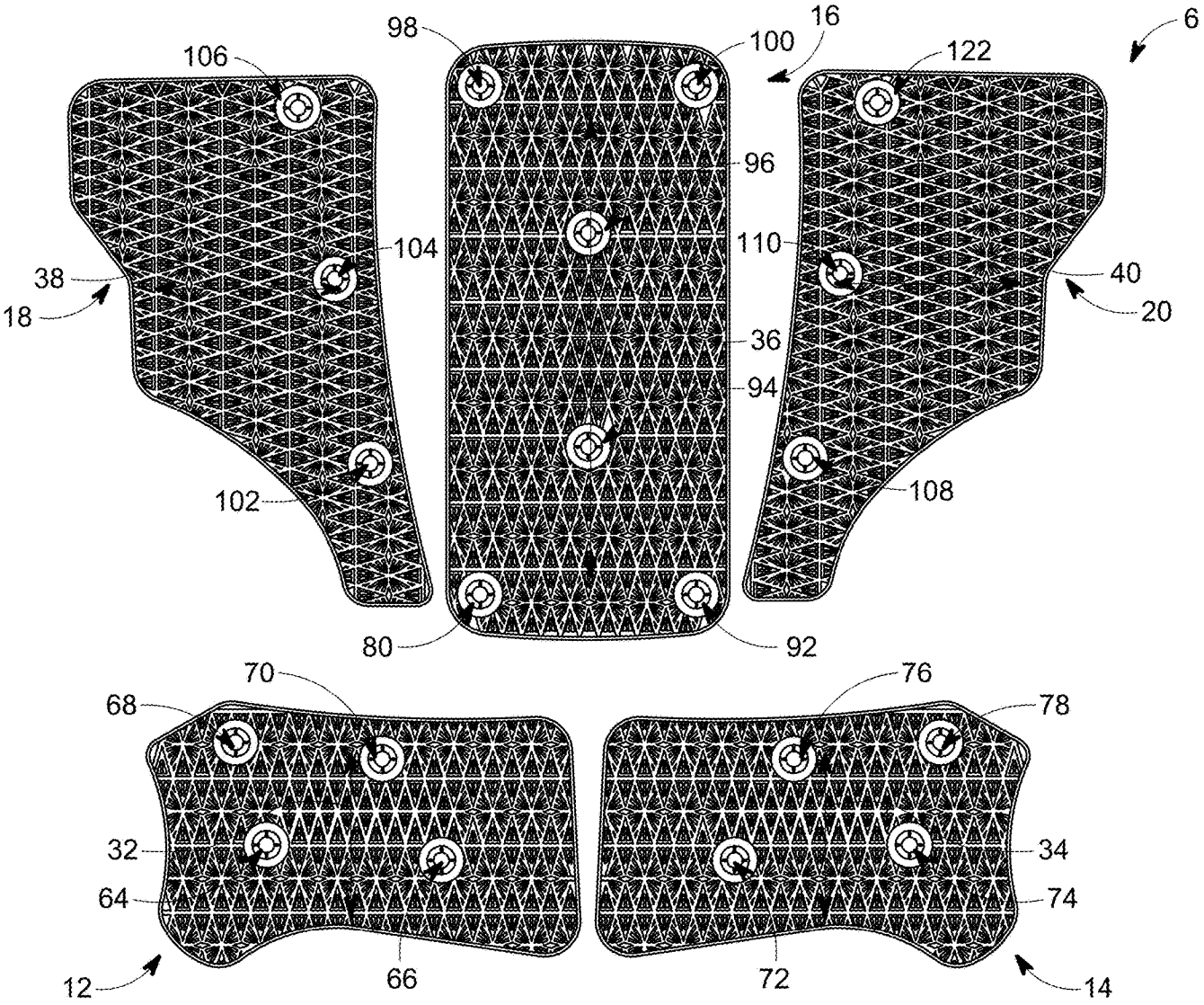
FIG. 4 is an inner-side plan view of the comfort liner of FIG. 3.

The units 12-20 of the comfort liner 6 are preferably configured to prevent rotation of the helmet 2 relative to a wearer's head when the units 12-20 encounter shear forces in the dimensions or directions shown by arrows 32-40 shown in FIG. 4. The frontal units 12, 14 and the top unit 16 preferably prevent rotation of the helmet 2 in the median dimension (forward-rearward direction) as shown by arrows 32-36. The side units 18, 20 preferably prevent rotation of the helmet 2 in the coronal or frontal dimension (left-right direction) as shown by arrows 38, 40. In other versions, the structures of the side units 18, 20 allow rotation of the helmet 2 in the frontal dimension and prevent rotation of the helmet 2 in the median dimension. The units 12-20 are preferably elastically compressible in the radial dimension, which is generally orthogonal to the local surface of the wearer's head and defines the inward-outward direction (in and out of the page with respect to FIG. 4). Accordingly, the comfort liner 6 preferably facilitates making the helmet 2 comfortable for the wearer while also maintaining the gear mounted on the helmet 2 at a substantially fixed position relative to the wearer's eyes. As a result, the comfort liner 6 preferably facilitates increasing usability of the helmet 2 and also preferably facilitates reducing strain imposed upon the wearer due to the gear and the helmet 2 moving relative to the wearer's head.

Figure 5:
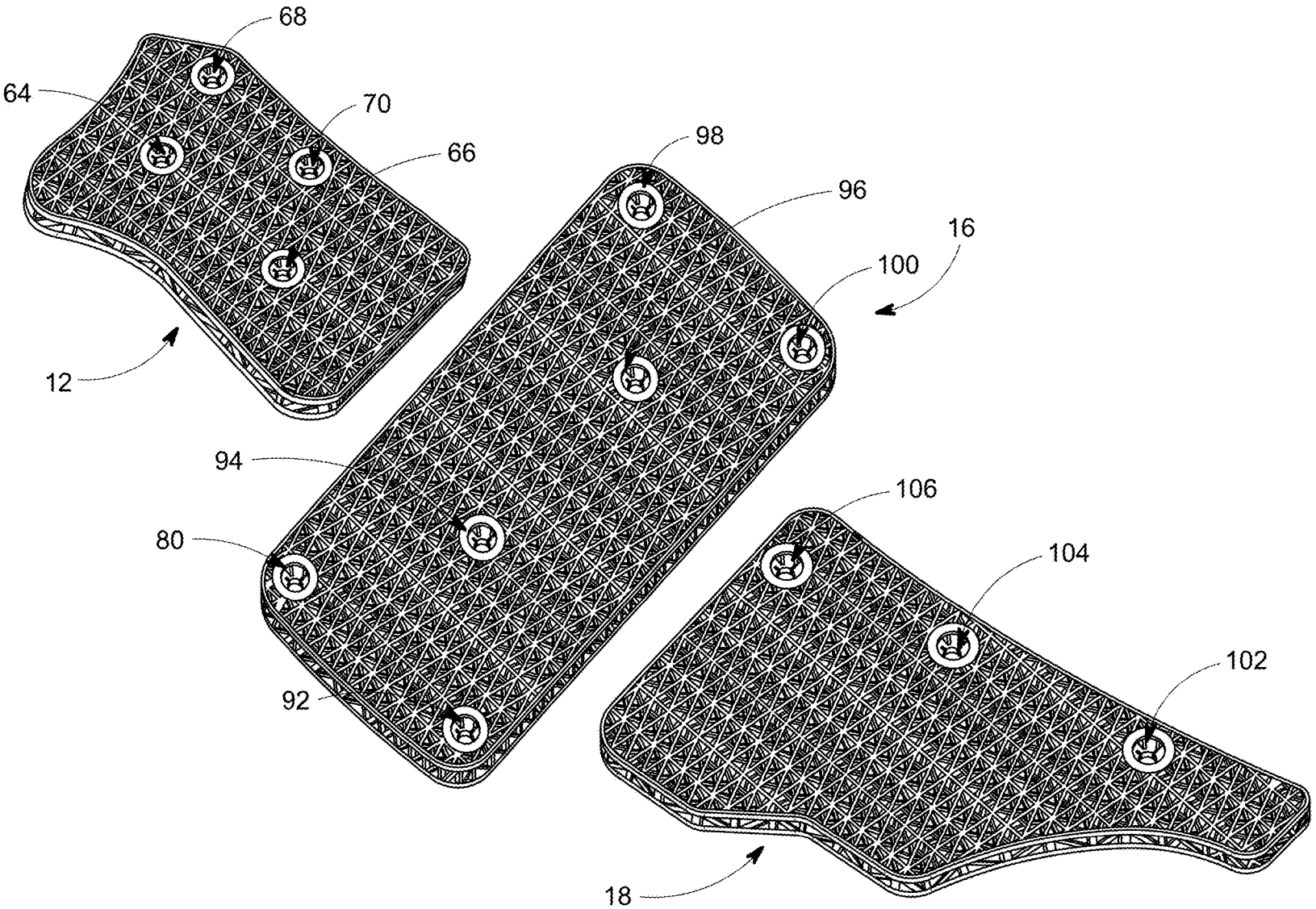
FIG. 5 is an inner-side perspective view of a side unit, a top unit, and a frontal unit of the comfort liner of FIG. 3.
Figure 6:
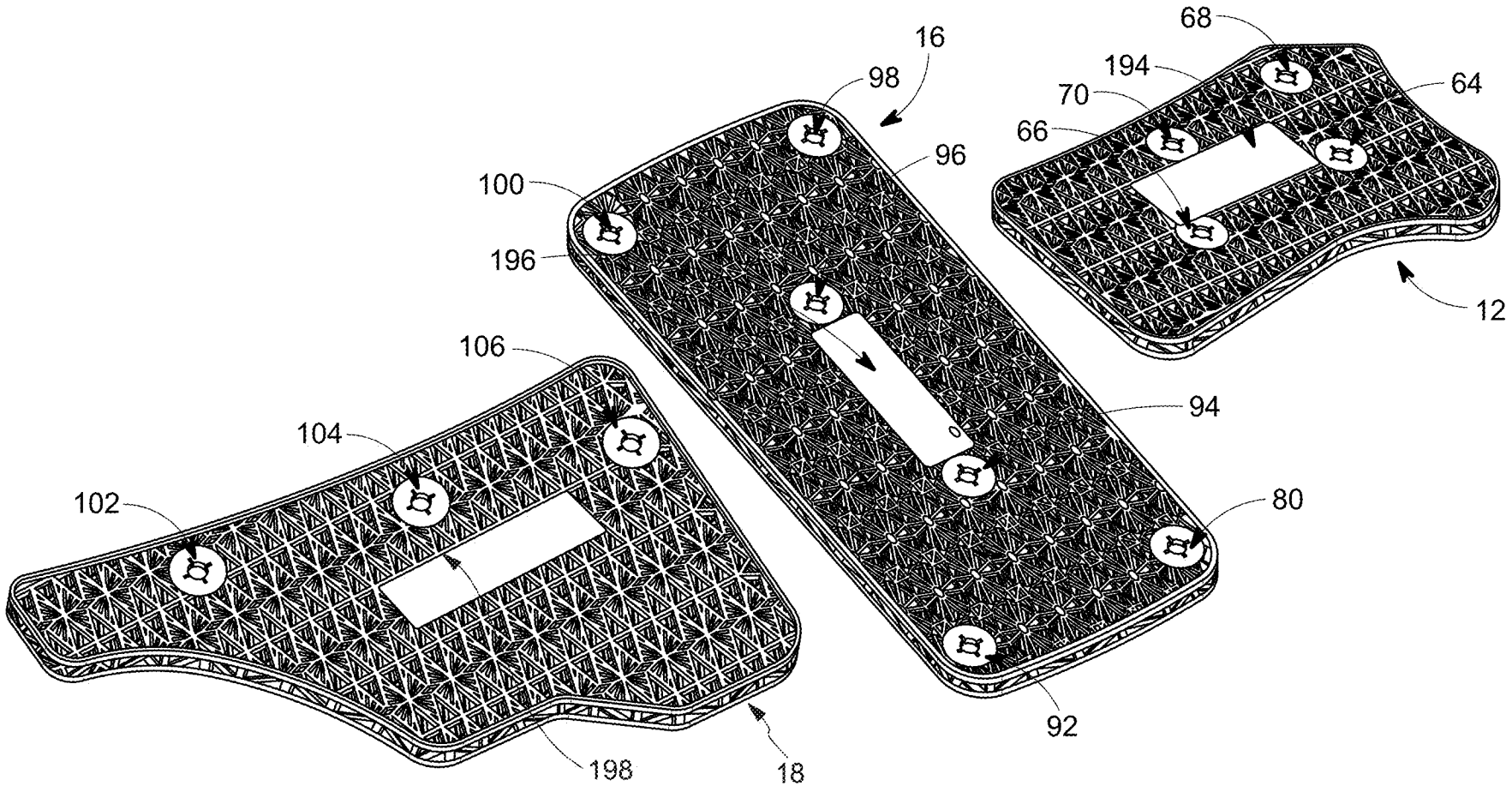
FIG. 6 is an outer-side perspective view of the comfort-liner units of FIG. 5.

As shown in the inner-side view of FIG. 5 and the outer-side view of FIG. 6, the units 12-20 (only units 12, 16, 18 shown in these Figures) preferably include latticed structures. FIGS. 7-9 and 11 show the latticed structure of the top unit 16 at various angles. The latticed structure of the top unit 16 is representative of the latticed structures of the other units 12, 14, 18, 20 and preferably has multiple layers of different lattice patterns to resist shear in mainly one axis. The latticed structure is preferably oriented in the unit 16 to prevent rotation of the helmet 2 in the dimension shown in FIG. 4. Accordingly, in FIG. 4, the latticed structure of the side units 18, 20 is oriented 90° about the radial dimension relative to the latticed structure of the top unit 16, and the latticed structures of the frontal units 12, 14 are parallel to the latticed structure of the top unit 16. In this manner, the frontal units 12, 14 and the top unit 16 preferably prevent rotation of the helmet 2 in the frontal dimension and allow rotation of the helmet 2 relative to the wearer's head in the median dimension, and the side units 18, 20 preferably prevent rotation of the helmet 2 relative to the wearer's head in the median dimension and allow rotation of the helmet 2 in the frontal dimension. In other versions, the latticed structures of the side units 18, 20 are oriented parallel to the latticed structure of the top unit 16 and, thus, prevent rotation of the helmet 2 in the median dimension. The latticed structures preferably include a carbon material. The latticed structures are preferably manufactured using continuous liquid interface production (CLIP), such as the CLIP manufacturing process available from CARBON.

Figure 7:
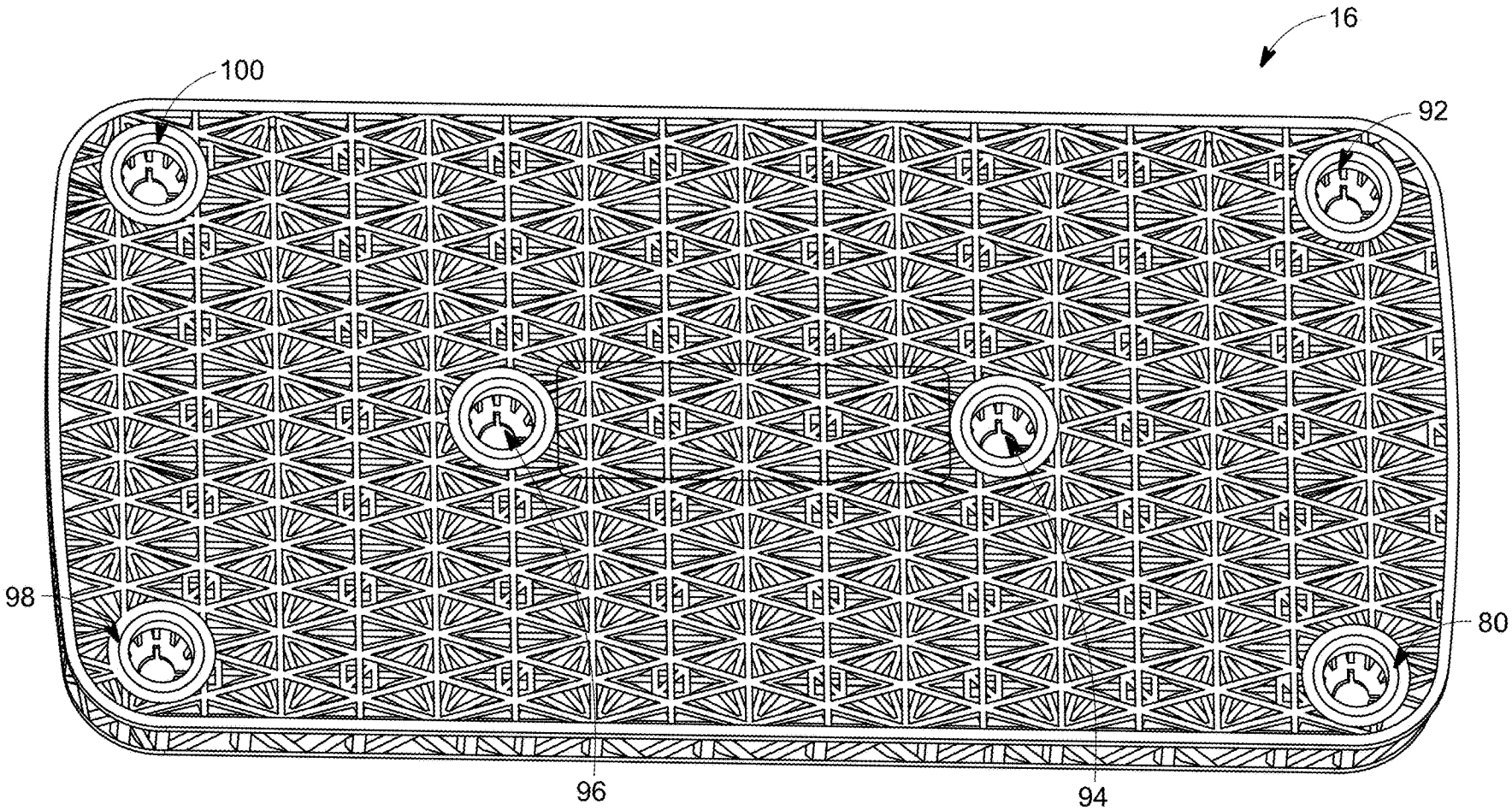
FIG. 7 is an inner-side perspective view of the top unit of FIG. 5.
Figure 8:
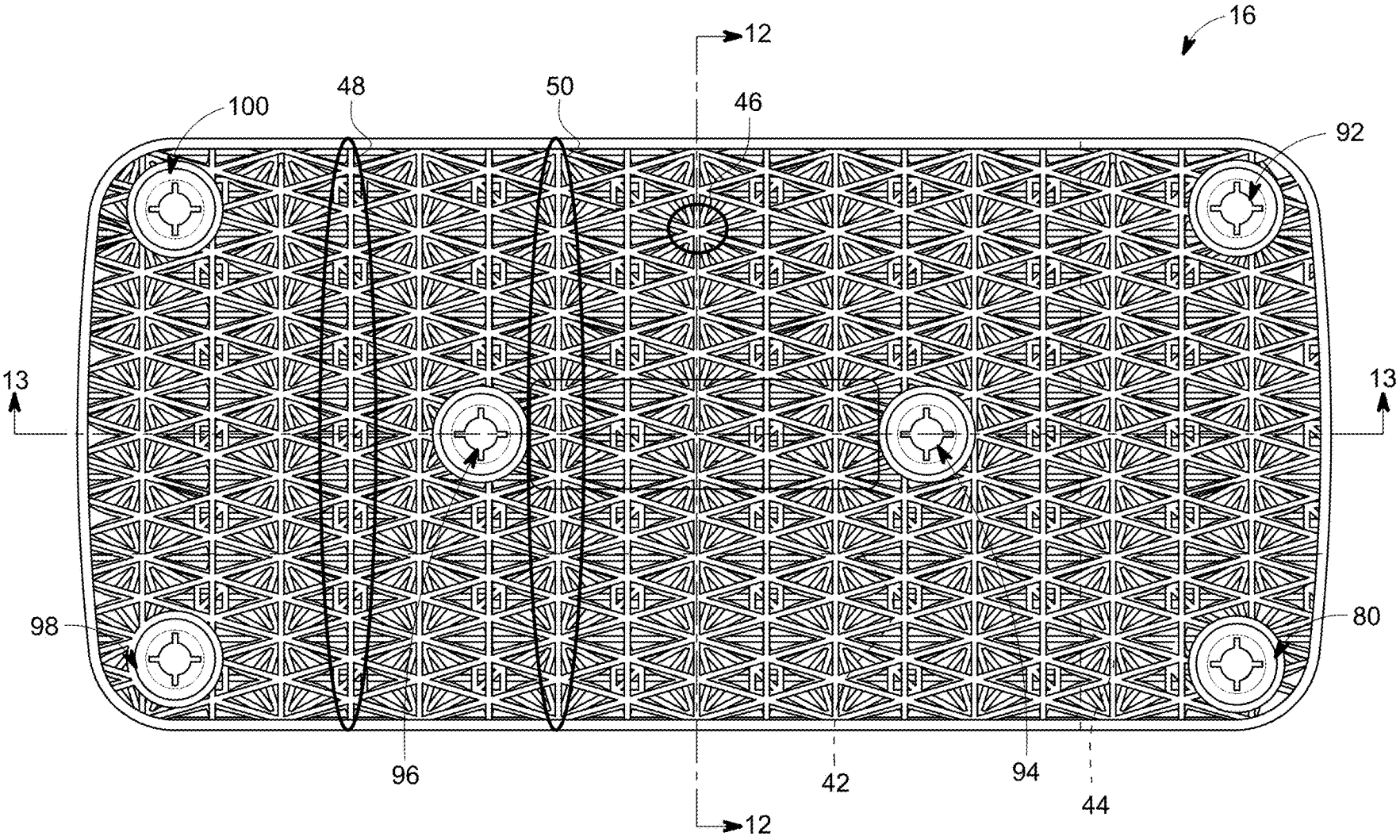
FIG. 8 is an inner-side view of the top unit of FIG. 5.

As shown in FIGS. 7 and 8, the inner-most layer of the latticed structure preferably includes triangular structures. The triangular structures preferably each have an altitude that is parallel to the dimension in which the unit prevents rotation of the helmet 2 (for example, the median dimension for the top unit 16). Most preferably, the triangle structures define substantially isosceles triangles with the longest altitude of each triangle being parallel to the dimension in which the unit prevents rotation of the helmet 2. As shown in FIG. 8, the triangle structures are preferably arranged in an array (for example, a two-dimensional array), wherein each column is defined by altitudes of the triangle structures in the column as represented for example by the line 42. Adjacent triangle structures in a column (triangle structures that share a vertex or a side) preferably have opposite orientations. Adjacent triangle structures in adjacent columns (triangle structures that share a side) preferably have opposite orientations. Accordingly, adjacent triangle structures in a row (for example, the row represented by the line 44) preferably have opposite orientations. Every fifth triangle structure in a row preferably has a vertex that is radially aligned with a convergence point that is disposed outward of such vertex and inward of the outermost layer of the latticed structure, such as the convergence point highlighted by the circle 46 (see also FIG. 12). The convergence points are defined by intersections of two or more cross-members that define the latticed structure, wherein such intersections are disposed between and spaced apart from the innermost and outmost layers of the latticed structure (see FIGS. 12 and 13). As shown in FIG. 8, the base of each triangular structure (for example, the shortest side) is preferably aligned with every other triangular structure in the row such that those bases define a beam that extends across the latticed structure, such as the beams highlighted by the ellipses 48, 50.

Figure 9:
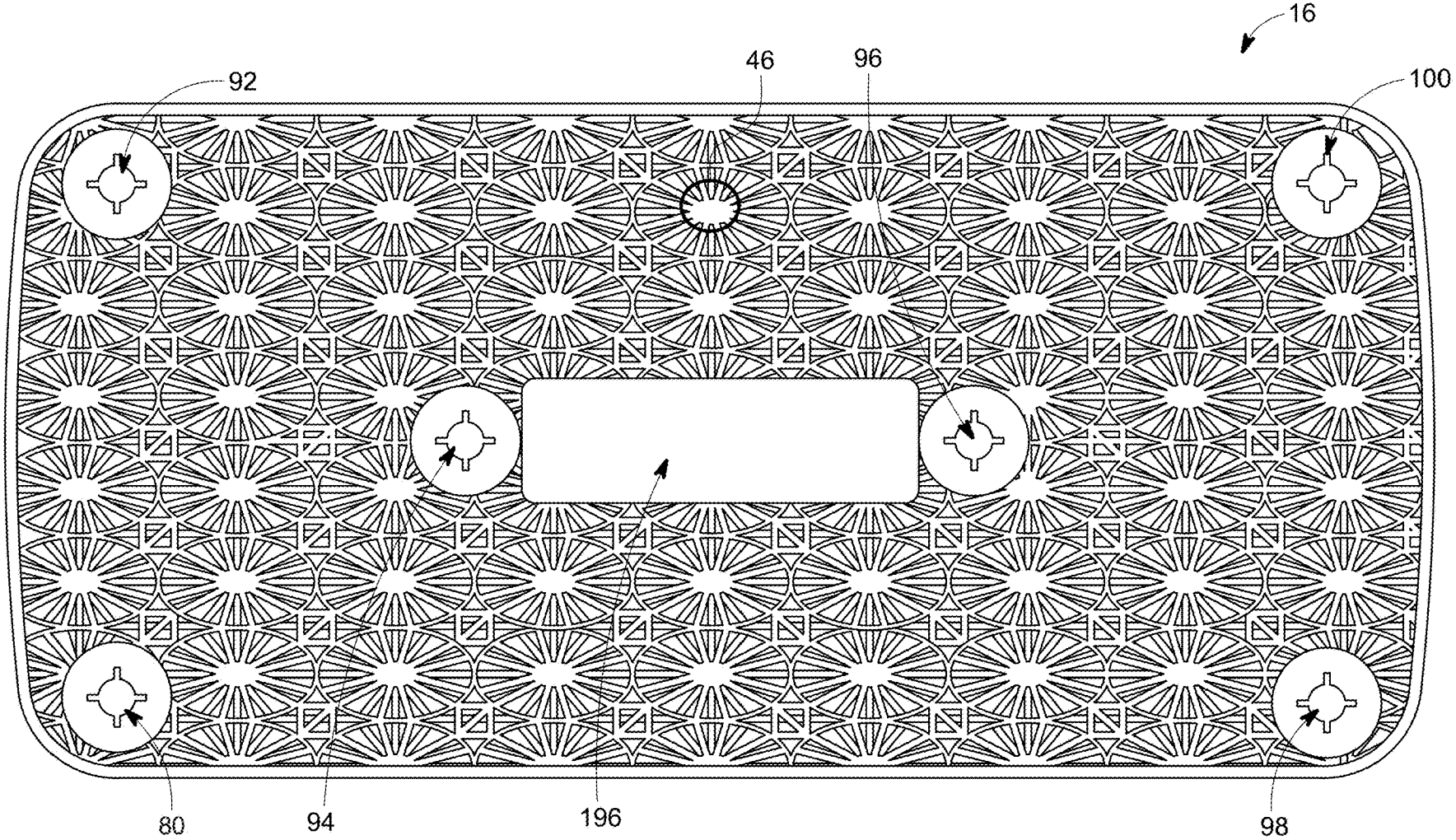
FIG. 9 is an outer-side view of the top unit of FIG. 5.
Figure 10:
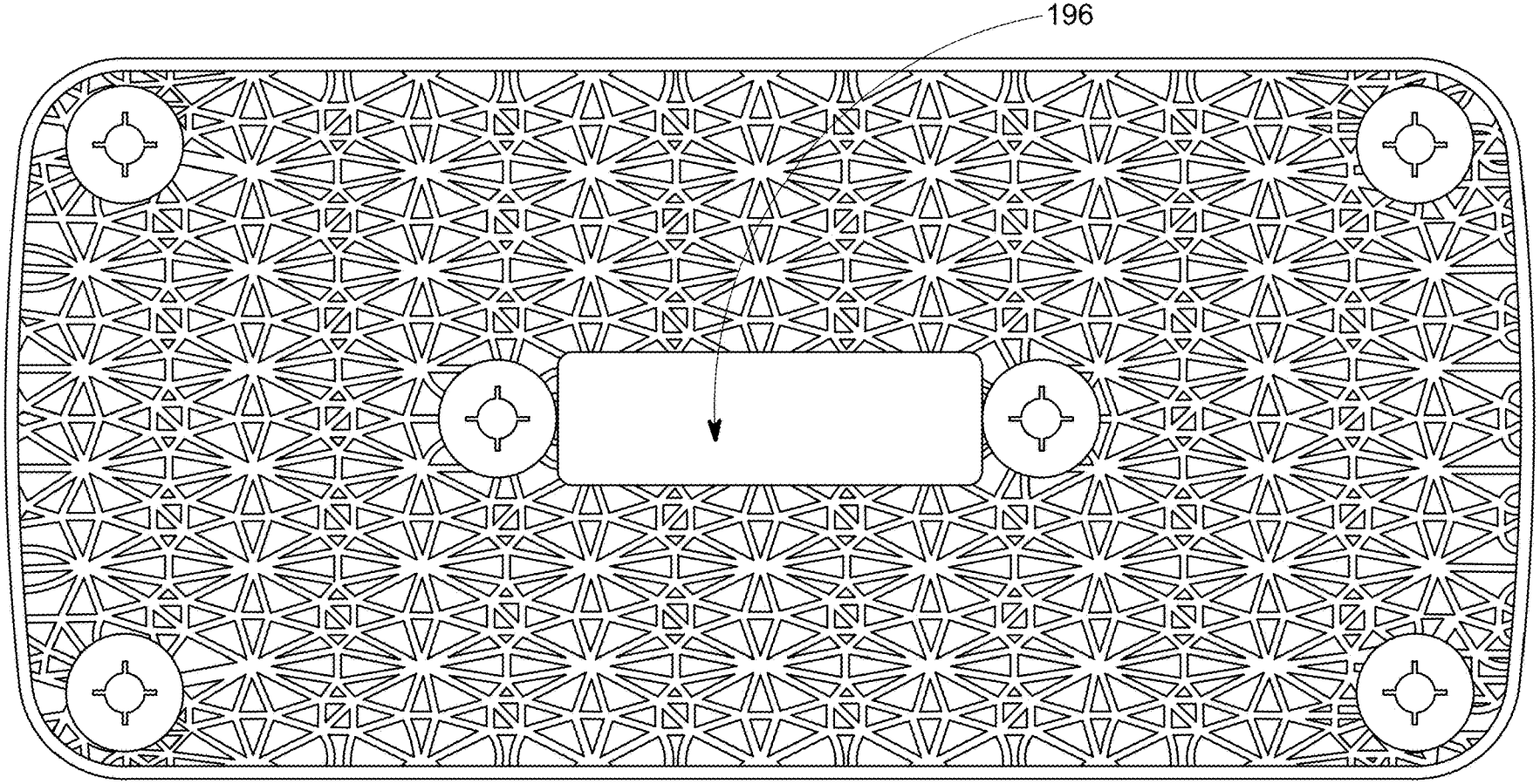
FIG. 10 is a view of the outermost layer of the top unit of FIG. 5.
Figure 11:
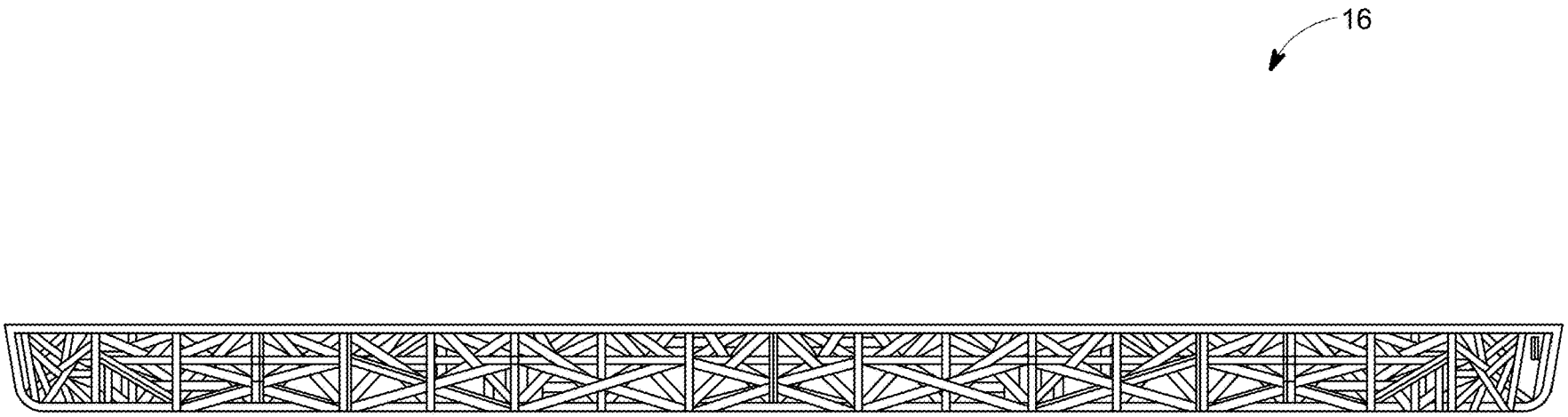
FIG. 11 is an elevational side view of the top unit of FIG. 5.

As shown in FIGS. 9 and 10, the outermost layer of the latticed structure preferably has a different latticed arrangement than the innermost layer of the latticed structure. The outermost layer of the latticed structure preferably has intersections that are radially aligned with the convergence points that are disposed between the innermost and outermost layers of the latticed structure, such as the convergence point highlighted by the circle 46 (see also FIG. 12).

Figure 12:
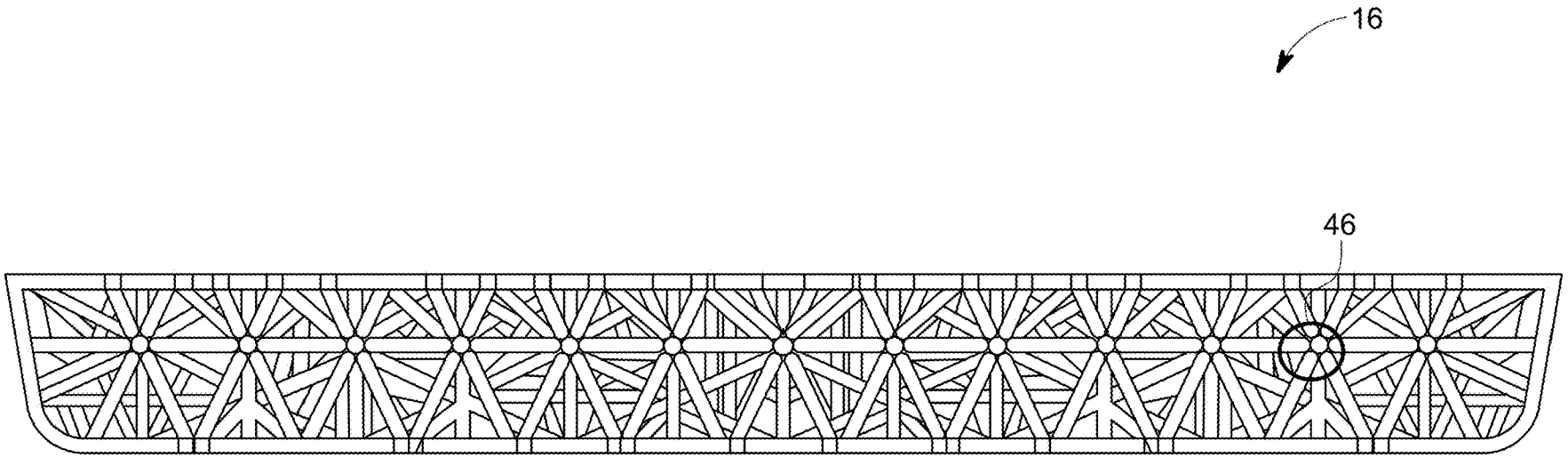
FIG. 12 is a cross-sectional view of the top unit of FIG. 5, taken along line 12-12 in FIG. 8.
Figure 13:
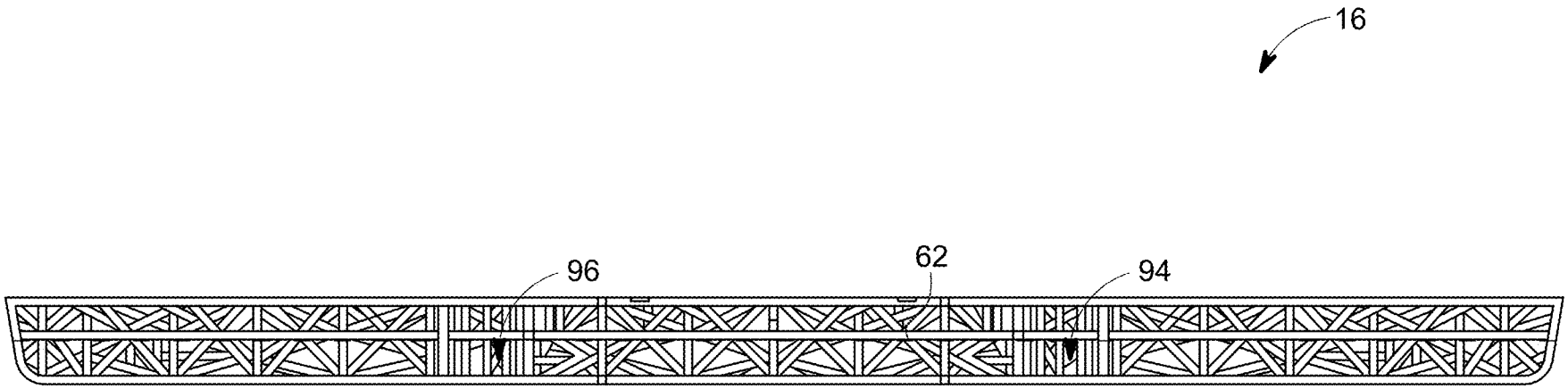
FIG. 13 is a cross-sectional view of the top unit of FIG. 5, taken along line 13-13 in FIG. 8.

As shown in the cross-sectional views of FIGS. 12 and 13, the convergence points between the innermost layer (downward facing in FIGS. 11-13) and outermost layer (upward facing in FIGS. 11-13) of the latticed structure are defined by cross-members that are oriented at different angles relative to the longitudinal axis 62 of the latticed structure. This arrangement preferably facilitates preventing rotation of the helmet 2 in the dimension parallel to the longitudinal axis 62 of the latticed structure, even when the latticed structure is compressed and bent in accordance with the contour of the wearer's head and the inner surface of the impact liner 8 (see FIG. 3).

Figure 14:
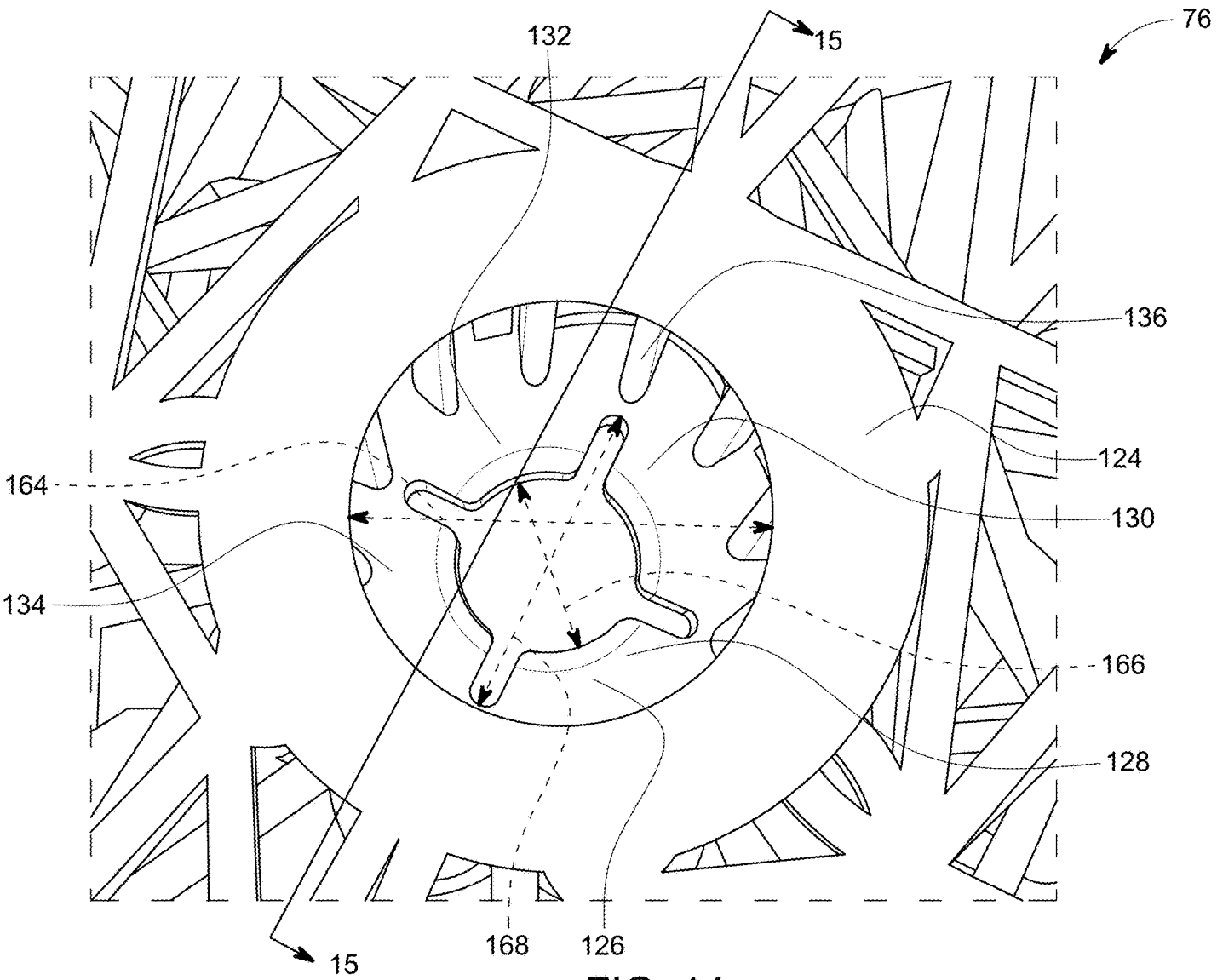
FIG. 14 is a close-up view of a receptacle in the top unit of FIG. 5.

Each of the units 12-20 preferably has one or more couplers, such as receptacles 64-80,92-110,122 (see FIG. 4), that facilitate coupling the comfort liner 6 to the impact liner 8 or the shell 10. FIG. 14 shows a close-up view of one of the receptacles, such as the receptacle 76, which is representative of the other receptacles. The inner portion of the receptacle 76 preferably has an inner collar 124 that defines an inner opening of the receptacle 76. The inner collar 124 preferably extends around the perimeter of the receptacle 76 and, most preferably, is continuous and devoid of tabs. The outer portion of the receptacle 76 preferably has an outer collar 126. The outer collar 126 preferably has tabs, such as tabs 128-134, that extend toward the center of the outer collar 126 and define an outer opening of the receptacle 76. The receptacle 76 preferably has non-solid walls such as multiple columns that extend from the inner collar 124 to the outer collar 126, such as column 136 and column 138 (see FIG. 15).

Figure 15:
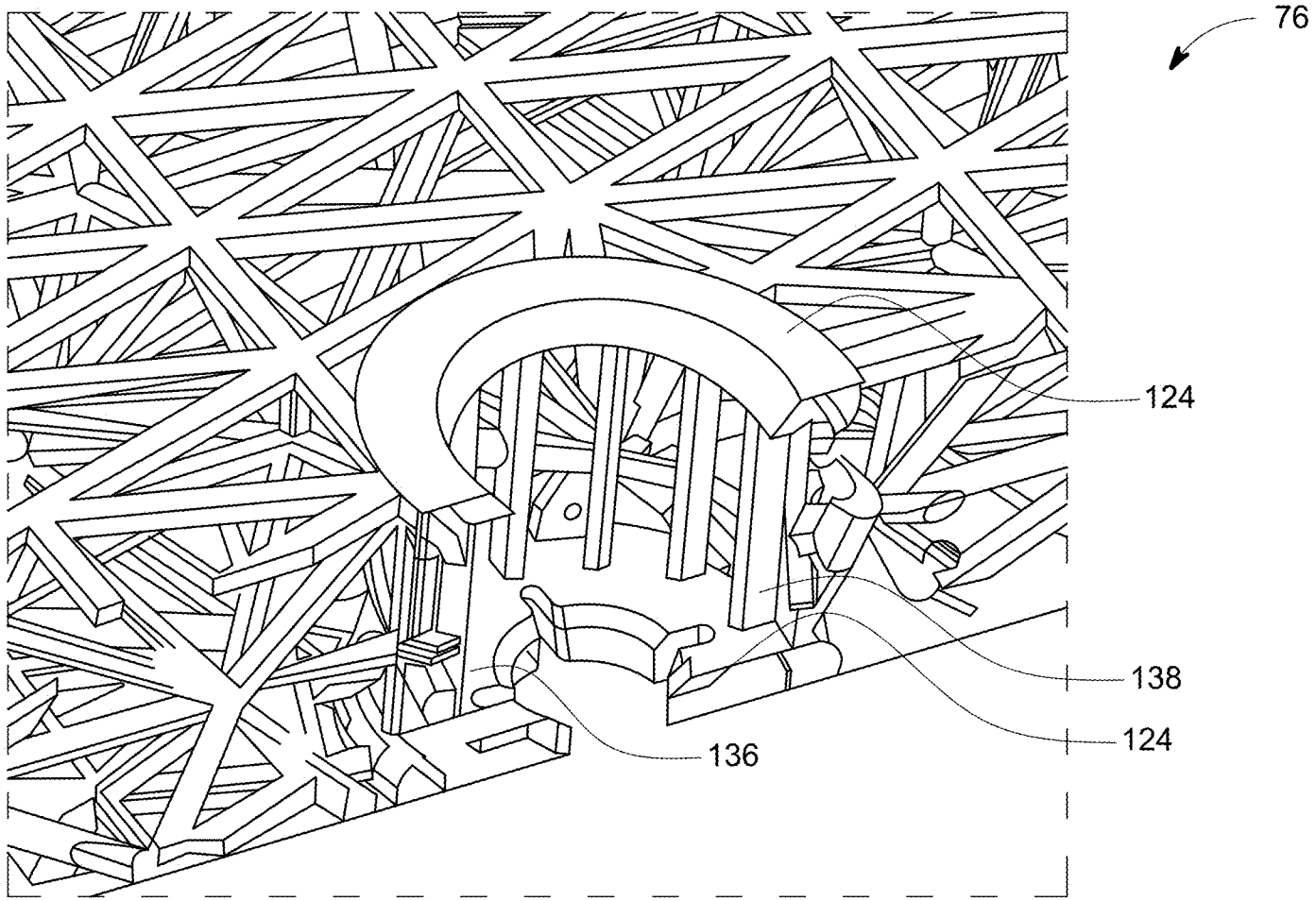
FIG. 15 is a cross-sectional view of the receptacle of FIG. 14, taken along the line 15-15 in FIG. 14.

The columns preferably have substantially the same shape and dimensions as each other. As shown in FIG. 15, the columns such as the column 138 are preferably non-cylindrical and, most preferably, have an elliptical cross section as measured substantially parallel to the innermost and outermost layers of the latticed structure. The columns are preferably configured to collapse upon an impact force to the helmet 2 to prevent transfer of energy from the impact liner 8 to the wearer's head.

Figure 16:
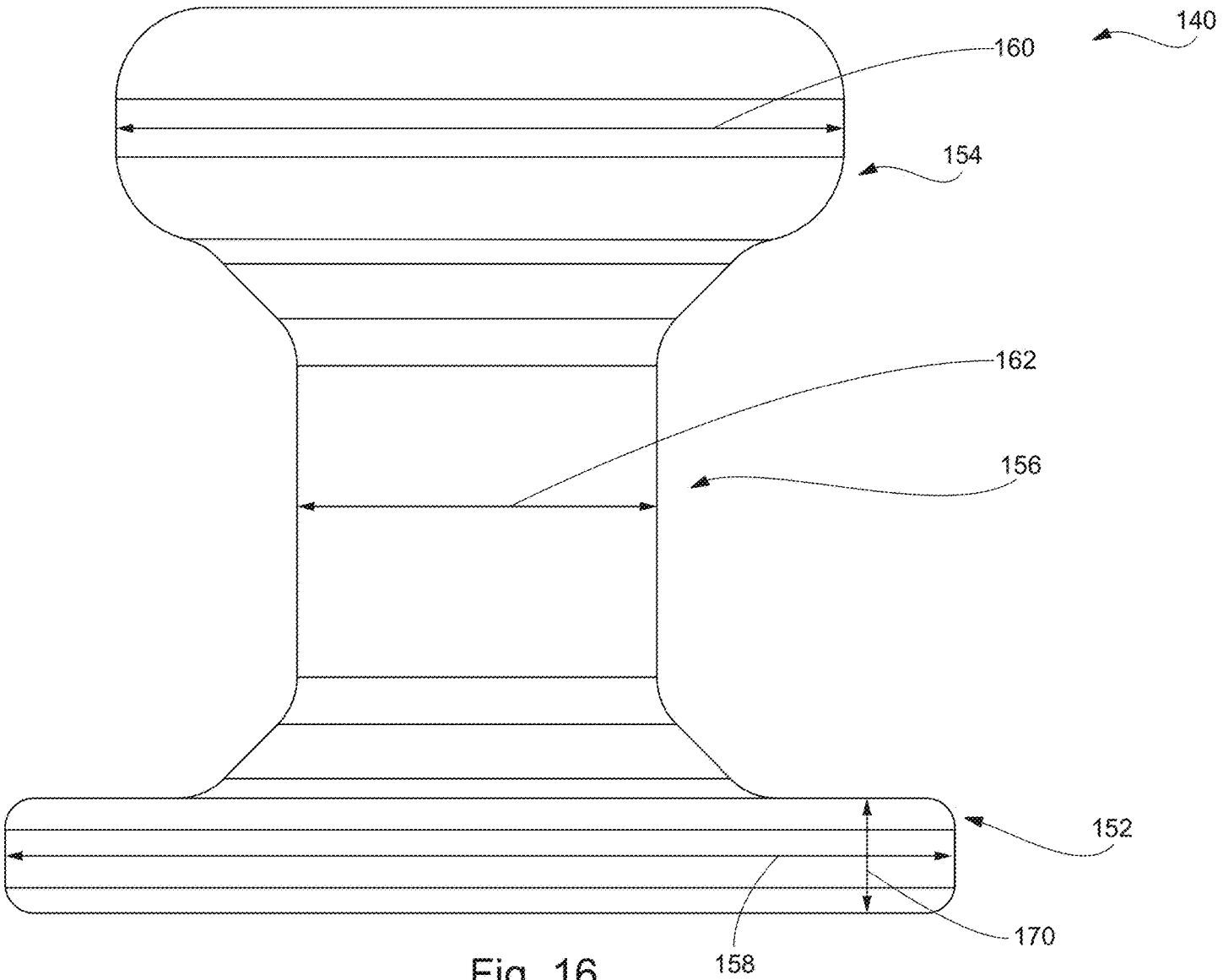
FIG. 16 is an elevational side view of a preferred pin that is configured to couple the comfort liner of FIG. 3 to a helmet.

The receptacles 64-80, 92-110, 122 are preferably configured to receive respective couplers such as pins (for example, studs), such as the pin 140 shown in FIG. 16, that facilitate coupling the comfort liner 6 to the impact liner 8 or the shell 10. The pin 140 preferably has a base 152 and a plug 154 that extends away from the base 152. The plug 154 is preferably spaced apart from the base 152 by a neck 156. The base 152, plug 160, and neck 162 are preferably substantially cylindrical. The base 152 preferably has a diameter 158 that exceeds the diameter 160 of the plug 154, which preferably exceeds the diameter 162 of the neck 156.

As shown in FIG. 14, the inner opening of the receptacle 76 defined by the inner collar 124 preferably has a diameter 164 that exceeds the diameter 158 of the base 152 to facilitate receiving the pin 140 in the receptacle 76. The distance between opposite columns in the receptacle 76 is preferably at least as great as the diameter 164 of the inner opening of the receptacle 76. The tabs 128-134 are preferably configured to transition between a default configuration (shown in FIG. 14) and a flexed configuration (not shown) when the plug 160 of the pin 140 is inserted through the outer opening of the receptacle 76. The tabs 128-134 preferably substantially return to the default configuration when the plug 160 completely passes the tabs 128-134 with the neck 162 of the pin 140 disposed in the outer opening of the receptacle 76 and the base 152 of the pin 140 disposed in the receptacle 76 opposite the tabs 128-134 from the plug 160.

Accordingly, the outer opening of the receptacle 76 preferably has two effective diameters: a default diameter 166 and an expanded diameter 168 (see FIG. 14).

The default diameter 166 is preferably smaller than the diameter 158 of the base 152 of the pin 140. The default diameter 166 preferably substantially matches or exceeds the diameter 162 of the neck 156. The expanded diameter 168 preferably substantially matches or exceeds the diameter 160 of the plug 154. The depth of the receptacle 76 is defined by the distance between the inner collar 124 and the outer collar 126, and the depth of the receptacle 76 is preferably at least as greater than the height 170 of the base 152 of the pin 140 (see FIG. 16). Most preferably, the depth of the receptacle 76 is multiple times greater than the height 170 of the base 152 to facilitate compression of the latticed structure while maintaining a gap between the base 152 and the wearer's head, thereby decreasing the likelihood that impact force is transferred to the wearer's head directly through the pin 140. Accordingly, the receptacle 76 is configured to receive the pin 140 such that the plug 154 extends outward from the latticed structure while the base 152 remains in the receptacle 76.

Figure 17:
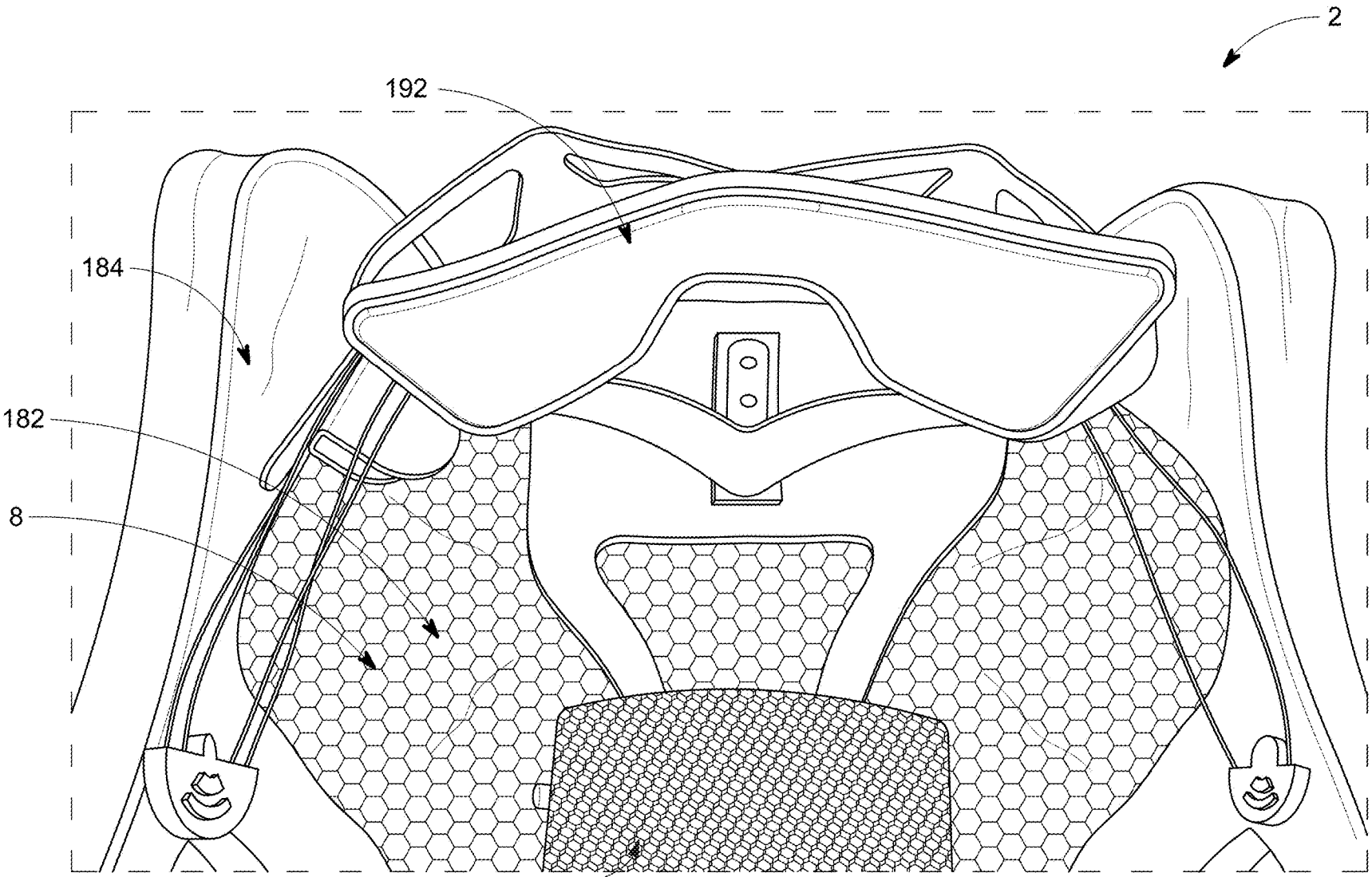
FIG. 17 is an underside view of the helmet of FIG. 1 with the top unit of the comfort liner of FIG. 3 installed without the fabric liner.

The pin 140 is preferably configured to secure the latticed structure within the helmet 2. The impact liner 8 is preferably distinct from the comfort liner 6. For example, the impact liner 8 preferably includes different materials that arranged in different configurations than the materials of the comfort liner 6. As shown in FIG. 17, the impact liner 8 of the helmet 2 preferably includes an arrangement 182 of hollow tubular members such as those available from KOROYD and described in U.S. Pat. No. 10,736,373. The diameter 160 of the plug 154 preferably exceeds the inner diameter of the hollow tubular members. The amount by which the diameter of the plug of each pin exceeds the inner diameter of the hollow tubular members is preferably sufficient to provide an interference fit that secures the comfort liner 6 to the impact liner 8 (for example, the interference fit is stronger than the force of gravity imparted to the impact liner 8) but small enough to prevent splitting the tubular members. The pins preferably include polymer such as injection-molded silicone or polyvinyl chloride (PVC).

The hollow-tube arrangement 182 is preferably interference fitted in impact-absorbing foam skeleton 184 (for example, expanded polystyrene (EPS) foam or expanded polypropylene (EPP) foam). Nuts (not shown) are preferably embedded in the foam skeleton 184 at locations that correspond to screw holes such as the screw hole 186 in the shell 10 (see FIG. 1). Accordingly, screws inserted through the screw holes in the shell couple the foam skeleton 184 of the impact liner 8 to the shell 10, the friction fit between the foam skeleton 184 and the hollow-tube arrangement 182 secures the arrangement 182 of hollow tubular members, and the pins couple the latticed structure to the impact liner 8. In other versions, the impact liner 8 has tubes embedded in the foam to facilitate receiving the pins in the embedded tubes to couple the comfort liner 6 to the impact liner 8, even if the impact liner 8 is devoid of the hollow-tube arrangement 182 and instead uses only foam as the impact-absorption mechanism.

Figure 18:
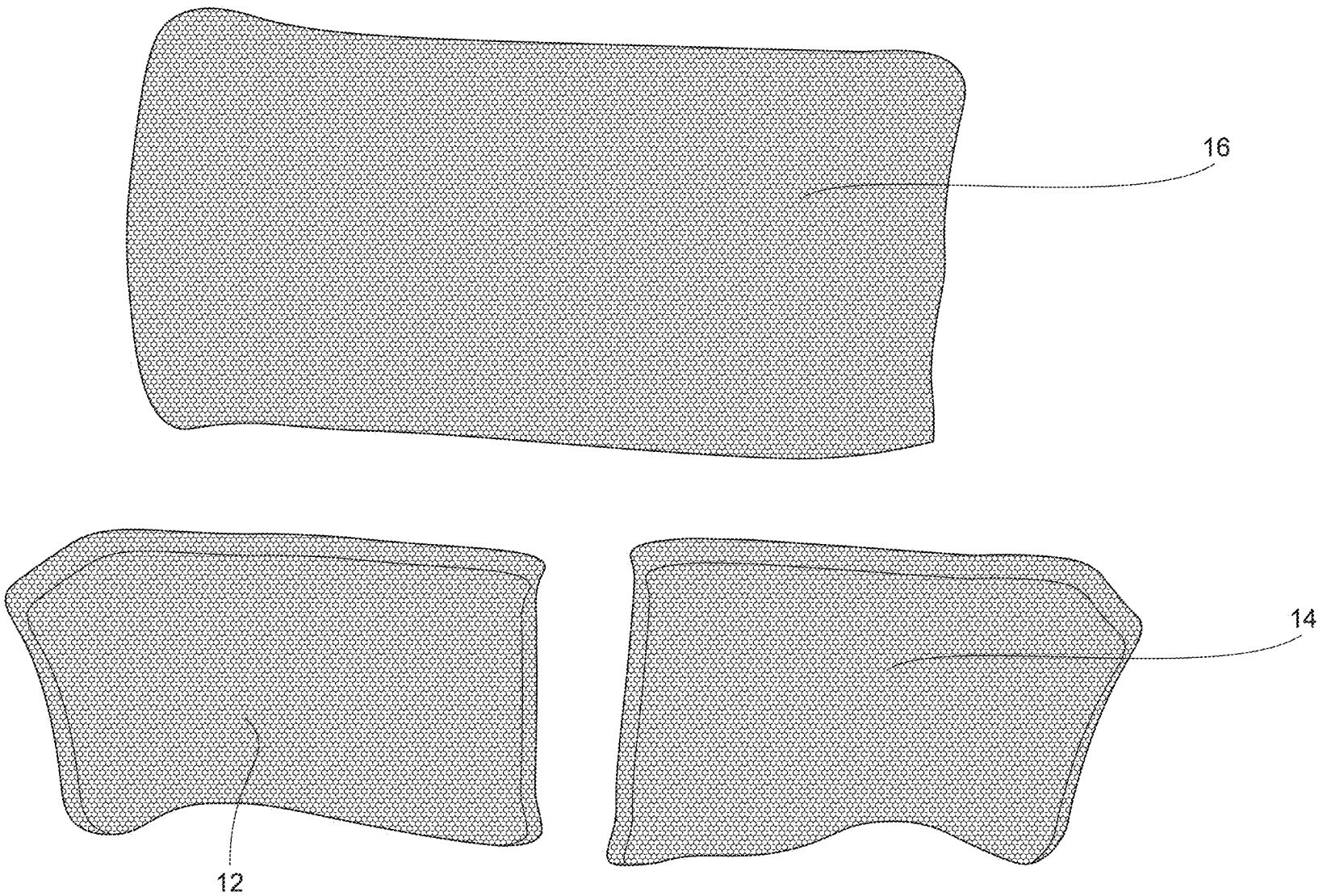
FIG. 18 is an inner-side view of the frontal units and the top unit of the comfort liner of FIG. 3 with preferred covers.
Figure 19:
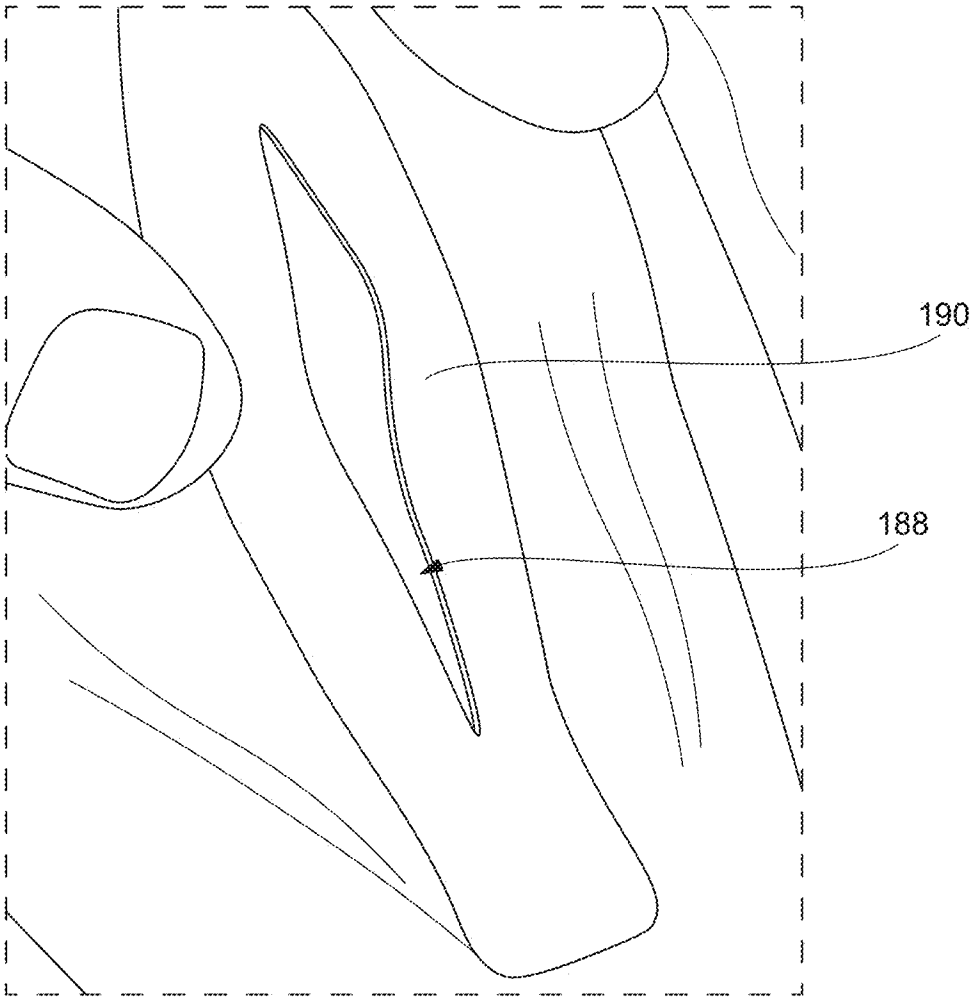
FIG. 19 is a close-up view of openings in the outer side of one of the covers of FIG. 18.

As shown in FIG. 18, comfort liner 6 preferably includes covers that surround the units 12-20 (liners not shown for the side units 18, 20). The covers preferably include fire-resistant material, such as a fire-resistant fabric that is a no-drip and self-extinguishing material such as fire-resistant material available from DRIFIRE. As shown in FIG. 19, the outer side of each cover preferably defines openings, such as the opening 188, positioned to align with the outer openings of the receptacles 64-80,92-110,122 when the covers cover the units 12-20 to facilitate the plugs of the pins extending beyond the cover and into the tubular members of the impact liner 8. The covers preferably have welded collars, such as the collar 190, that define the openings to prevent the openings from unintentionally expanding. The covers preferably prevent hair products from entering the latticed structures, thereby increasing the ease of cleaning the comfort liner 6.

The comfort liner 6 is preferably available in a variety of thicknesses (as measured in the radial dimension) to facilitate adapting the helmet 2 to a variety of head sizes or shapes. For example, the units 12-20 may be 7,10, or 13 millimeters thick in the radial dimension. When coupled to the impact liner 8, the units 12-20 preferably touch each other or are within a few millimeters of each other to facilitate installation with different combinations of sizes of the units 12-20. Although the comfort liner 6 covers a large portion of the wearer's head, the latticed structure preferably facilitates providing high venting and breathability compared to foam comfort liners. Although the comfort liner 6 provides substantially the same compressibility in the radial dimension as foam liners, the comfort liner preferably facilitates providing significantly greater resistance to shear force in comparison to foam liners in the dimensions discussed above. Moreover, the rear of the helmet 2 is preferably equipped with an occipital yoke 192 (see FIGS. 2 and 17) that facilitates the helmet 2 gripping the rear of the wearer's head and/or a chin-strap (not shown) to further prevent rotation of the helmet 2 in the frontal dimension. Accordingly, the comfort liner 6 achieves all of the advantages of typical comfort liners but also facilitates maintaining the positioning of gear coupled to the helmet 2 relative to the wearer's eyes as well as reducing strain experienced by the wearer, especially in a high-gravity environment (for example, a flight environment in which extreme flight maneuvers are performed). As shown in FIG. 6, the innermost layer or the outermost layer of the latticed structures preferably includes a surface, such as surfaces 194-198, that bears descriptive information, such as model or part numbers.

As used herein, the following terms take the meanings explicitly associated herein, unless the context clearly dictates otherwise. The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular. The term "one or more" discloses no more than a single one or more than one, up to and including all.

The terms "front," "forward," "rear," and "rearward" are defined relative to the shell 10 of the helmet 2 to orient the reader and do not limit the orientation of any described component in a given application. The front side of the helmet 2 is shown in FIG. 1 as having a visor. The term "median dimension" refers to a rotational dimension in the vertical plane that intersects the center of the helmet 2 and extends from the front of the helmet 2 to the rear of the helmet 2. The term "coronal dimension" or "frontal dimension" refers to a rotational dimension in the vertical plane that intersects the center of the helmet 2 and extends from the left of the helmet 2 to the right of the helmet 2. The term "radial dimension" refers to a linear dimension that extends radially outward from a wearer's head and is substantially orthogonal to the surface of the wearer's head at the location from which the radial dimension intersects the wearer's head. For example, an element that is radially aligned with another element are substantially disposed on the same radial vector that extends away from the wearer's head at an orientation that is substantially orthogonal to the surface of the wearer's head at the position where the vector intersects the wearer's head. The terms "inner", "inward", "outer", and "outward" are defined relative to the helmet 2, with the terms "inner" and "inward" referencing a direction extending toward the center of the helmet 2 and with the terms "outer" and "outward" referencing a direction extending away from the center of the helmet 2. The term "transverse" refers to a non-parallel orientation and includes but is not limited to a perpendicular orientation.

The term "configured" refers to an element being one or more of sized, dimensioned, positioned, or oriented to achieve or provide the recited function or result. The term "approximately", "generally", or "substantially" refers to the described value or a range of values that include all values within 5, 10, 20, 30, 40, or 50 percent of the described value. The term "substantially fixed" refers to fixed or movement of an element that is limited to 5, 10, 15, 20, 25, 30, 35, 40, 45, or less percent of a dimension of the element as measured parallel to the direction of movement.

The term "directly coupled" refers to a component that contacts (for example, when bolted) or is welded to another component. The term "indirectly coupled" refers to a component that is coupled to one or more other components that are coupled to a second component or one or more further components that are coupled to the second component. The term "coupled" should be understood to disclose both direct and indirect coupling of components or elements that are described as being coupled to each other.

While the preferred embodiment of the invention has been illustrated and described, as noted above, many changes can be made without departing from the spirit and scope of the invention. For example, the pins may be integral with the latticed structures. As another example, each disclosure of an element or component preferably having a feature or characteristic is intended to also disclose the element or component as being devoid of that feature or characteristic, unless the principles of the invention clearly dictate otherwise. Accordingly, the scope of the invention is not limited by the disclosure of the preferred embodiments. Instead, the invention should be determined entirely by reference to the claims that follow. Moreover, each feature, characteristic, element, or component described herein may be implemented in combination with one or more other features, characteristics, elements, or components described herein. It should also be noted that the claim dependencies or combinations of elements recited in the claims does not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (for example, "The comfort liner of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

I claim:

1. A comfort liner for a helmet, the comfort liner comprising:

a latticed structure configured to couple to the helmet, the latticed structure defining a surface that follows a contour of a portion of the helmet, the surface having a minor axis and a major axis, the latticed structure defining a radial dimension that is generally orthogonal to the minor axis and to the major axis, wherein the latticed structure is elastically compressible in the radial dimension, and wherein the latticed structure is configured to prevent rotation of the helmet relative to a wearer's head along the minor axis.

2. The comfort liner of claim 1, further comprising a coupler configured to couple the latticed structure to an impact liner that is disposed between the latticed structure and a shell of the helmet.

3. The comfort liner of claim 1, wherein the latticed structure has multiple layers of different lattice patterns.

4. The comfort liner of claim 3, wherein the multiple layers include a layer that has a plurality of triangular structures arranged in an array of columns and rows.

5. The comfort liner of claim 4, wherein every fifth triangular structure in one of the rows has a vertex that is radially aligned with a convergence point that is disposed in a different layer than the layer having the plurality of triangular structures.

6. The comfort liner of claim 1, wherein the latticed structure is configured to prevent rotation of the helmet relative to the wearer's head in a median dimension.

7. The comfort liner of claim 6, wherein the latticed structure is configured to allow rotation of the helmet relative to the wearer's head in a frontal dimension.

8. A comfort liner for a helmet, the comfort liner comprising:

a latticed structure configured to couple to the helmet, wherein the latticed structure is elastically compressible and configured to prevent rotation of the helmet relative to a wearer's head in at least one dimension; and a receptacle disposed in the latticed structure, the receptacle configured to receive a pin that is configured to extend through the receptacle to an impact liner or a shell of the helmet.

9. The comfort liner of claim 8, wherein the receptacle has an inner collar, an outer collar, and a plurality of columns that extend from the inner collar to the outer collar, the columns being spaced apart from each other about a perimeter of the receptacle.

10. The comfort liner of claim 9, wherein the columns are elastically collapsible.

11. The comfort liner of claim 9, wherein the receptacle defines a radial axis, and the columns have a non-circular cross-section as measured in a dimension that is transverse to the radial axis.

12. The comfort liner of claim 1, further comprising a side unit, the latticed structure defining a top unit configured to be disposed radially outward from a top of the wearer's head or a frontal unit configured to be disposed radially outward from the wearer's forehead, the side unit including another latticed structure configured to couple to the helmet, wherein the other latticed structure of the side unit is elastically compressible and prevents rotation of the helmet relative to the wearer's head in a dimension that is transverse to another dimension included in the at least one dimension.

13. The comfort liner of claim 1, further comprising a frontal unit, the latticed structure defining a top unit configured to be disposed radially outward from a top of the wearer's head, the frontal unit including another latticed structure configured to couple to the helmet, wherein the other latticed structure of the frontal unit is elastically compressible and prevents rotation of the helmet relative to the wearer's head in a dimension that is included in the at least one dimension.

14. A comfort liner for a helmet, the comfort liner comprising:

a latticed structure configured to couple to the helmet, wherein the latticed structure is elastically compressible and configured to prevent rotation of the helmet relative to a wearer's head in at least one dimension; and a fabric cover that is configured to cover the latticed structure, wherein the cover has an inner side and an outer side, the outer side of the cover defining an opening that is configured to align with a coupler that extends from the latticed structure to facilitate coupling the latticed structure to the helmet.

15. A comfort liner for a helmet having a shell and an impact liner, the comfort liner comprising:

an elastically compressible latticed structure configured to couple to the impact liner and prevent rotation of the helmet relative to the wearer's head in a median dimension.

16. The comfort liner of claim 15, wherein the latticed structure has multiple layers of different lattice patterns.

17. The comfort liner of claim 15, wherein the latticed structure is configured to allow rotation of the helmet relative to the wearer's head in a frontal dimension.

18. The comfort liner of claim 1, wherein the latticed structure is configured to allow rotation of the helmet along the major axis.

19. A comfort liner for a helmet, the comfort liner comprising:

a latticed structure configured to couple to the helmet, the latticed structure defining a surface that follows a contour of a portion of the helmet, the surface having a minor axis and a major axis, wherein the latticed structure is elastically compressible, wherein the latticed structure is configured to prevent rotation of the helmet relative to a wearer's head along the major axis.

20. The comfort liner of claim 19, wherein the latticed structure is configured to prevent rotation of the helmet relative to the wearer's head in a frontal dimension.

21. The comfort liner of claim 20, wherein the latticed structure is configured to allow rotation of the helmet relative to the wearer's head in a median dimension.

22. The comfort liner of claim 19, wherein the latticed structure is configured to allow rotation of the helmet along the minor axis.

23. A comfort liner for a helmet, the comfort liner comprising:

a first latticed structure configured to couple to the helmet; and a second latticed structure configured to couple to the helmet, wherein the first and second latticed structures are elastically compressible, wherein the first latticed structure is configured to prevent rotation of the helmet relative to a wearer's head in a median dimension, and wherein the second latticed structure is configured to prevent rotation of the helmet relative to the wearer's head in a frontal dimension.

24. The comfort liner of claim 23, wherein the first latticed structure is configured to allow rotation of the helmet in the frontal dimension.

25. The comfort liner of claim 24, wherein the second latticed structure is configured to allow rotation of the helmet in the median dimension.

* * * * *